US007377245B2

(12) United States Patent
Morii et al.

(10) Patent No.: US 7,377,245 B2
(45) Date of Patent: May 27, 2008

(54) VALVE TIMING CONTROLLER

(75) Inventors: Yasushi Morii, Nagoya (JP); Motoki Uehama, Kariya (JP)

(73) Assignee: Denso Corporation, Kariya, Aichi-pref. (JP)

( * ) Notice: Subject to any disclaimer, the term of this patent is extended or adjusted under 35 U.S.C. 154(b) by 0 days.

(21) Appl. No.: 11/798,824

(22) Filed: May 17, 2007

(65) Prior Publication Data

US 2007/0295294 A1 Dec. 27, 2007

(30) Foreign Application Priority Data

Jun. 22, 2006 (JP) ..... 2006-172941

(51) Int. Cl.
*F01L 1/34* (2006.01)

(52) U.S. Cl. ..... 123/90.17; 123/90.15; 123/90.31

(58) Field of Classification Search ..... 123/90.17, 123/90.15, 90.31
See application file for complete search history.

(56) References Cited

U.S. PATENT DOCUMENTS

2003/0005899 A1* 1/2003 Scheidt ..... 123/90.17
2006/0112921 A1 6/2006 Schafer et al.

FOREIGN PATENT DOCUMENTS

DE 41 10 195 10/1992
JP 2005-98142 4/2005
JP 2005-146993 6/2005

* cited by examiner

*Primary Examiner*—Zelalem Eshete
(74) *Attorney, Agent, or Firm*—Nixon & Vanderhye P.C.

(57) ABSTRACT

A valve timing controller includes an electric motor generating a cogging torque on the motor shaft, an current control means for controlling an electricity supplied to the electric motor, and a phase-changing mechanism varying a relative rotational phase between the crankshaft and the camshaft according to a rotation of the motor shaft. The cogging torque has a peak value which is greater than an absolute value of a cam torque applied to the motor shaft from the camshaft through the phase-changing mechanism.

6 Claims, 5 Drawing Sheets

VALVE TIMING CONTROLLER

CROSS-REFERENCE TO RELATED APPLICATION

This application is based on Japanese Patent Application No. 2006-172941 filed on Jun. 22, 2006, the disclosures of which is incorporated herein by reference.

FIELD OF THE INVENTION

The present invention relates to a valve timing controller which adjusts valve timing of at least one of an intake valve and an exhaust valve.

BACKGROUND OF THE INVENTION

It is known that a valve timing controller adjusts valve timing of an internal combustion engine by utilizing an electric motor or an electromagnetic brake. JP-2005-146993A shows a valve timing controller in which a relative phase difference between a crankshaft and a camshaft is maintained at a middle phase between the most advance phase and the most retarded phase in order to improve a startability and performance of the engine. In this valve timing controller, a sub-brake is provided besides an electromagnetic brake. The electromagnetic brake applies a brake torque from a brake shaft to a phase-changing mechanism in order to change the relative phase difference. The sub-brake is operated when the engine is turned off. The middle phase is obtained by a torque balance between the sub-brake and a spring provided in the phase-changing mechanism.

In this valve timing controller, a cam torque applied to the brake shaft from the camshaft is likely to vary in a large amount according to a temperature condition when the engine is operated at a low speed. It is relatively difficult to adjust the torque balance with high accuracy. Hence, the accuracy of the middle phase is deteriorated, so that it may be hard to start the engine properly.

SUMMARY OF THE INVENTION

The present invention has been made in view of the foregoing problem. It is an object of the present invention to provide a valve timing controller which adjusts valve timing suitable for a driving condition of the engine.

According to the present invention, the valve timing controller includes an electric motor generating a cogging torque on a motor shaft, an current control means for controlling an electricity supplied to the electric motor, and a phase-changing mechanism varying a relative rotational phase between the crankshaft and the camshaft. The cogging torque has a peak value which is greater than an absolute value of a cam torque applied to the motor shaft from the camshaft. Even if the cam torque due to the valve reacting force is applied to the motor shaft in a condition where the electric motor is deenergized, the cogging torque of the motor shaft overcomes the cam torque. As the result, the motor shaft is held at the starting phase even if the cam torque is applied, so that the valve timing becomes suitable for operating the engine, especially for starting the engine.

DETAILED DESCRIPTION OF THE PREFERRED EMBODIMENTS

Figure 1:
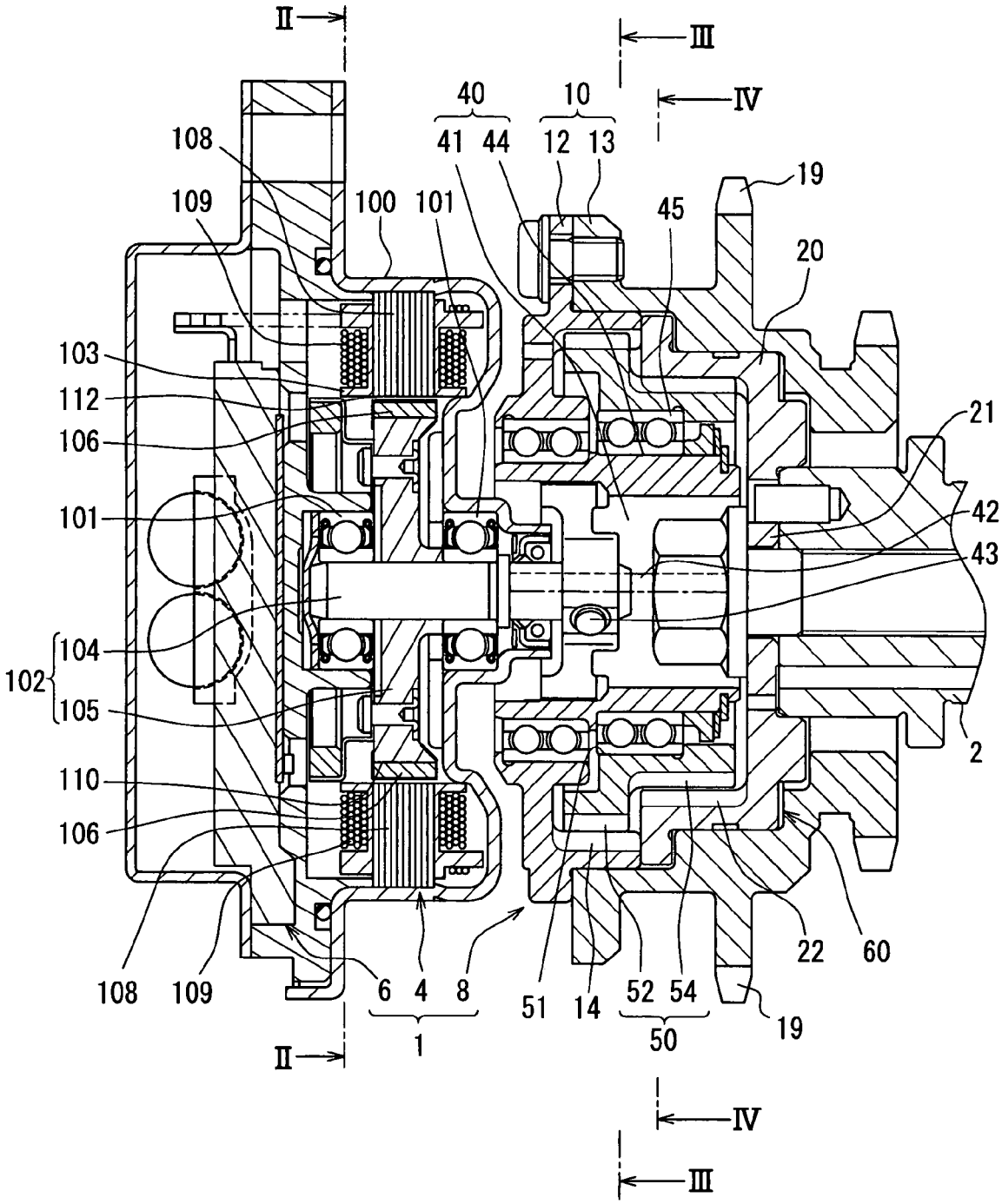
FIG. 1 is a cross sectional view showing a valve timing controller, taken along a line I-I in FIG. 3.

Embodiments of the present invention will be described hereinafter. FIG. 1 is a cross sectional view of a valve timing controller 1. The valve timing controller 1 is provided in a torque transfer system which transfers the torque of a crankshaft (not shown) to a camshaft 2 of an engine. The valve timing controller 1 includes an electric motor 4, a current control circuit 6, and a phase-change mechanism 8 so that a relative rotational phase difference between the crankshaft and the camshaft 2 is varied to adjust a valve timing of the intake valve.

Figure 2:
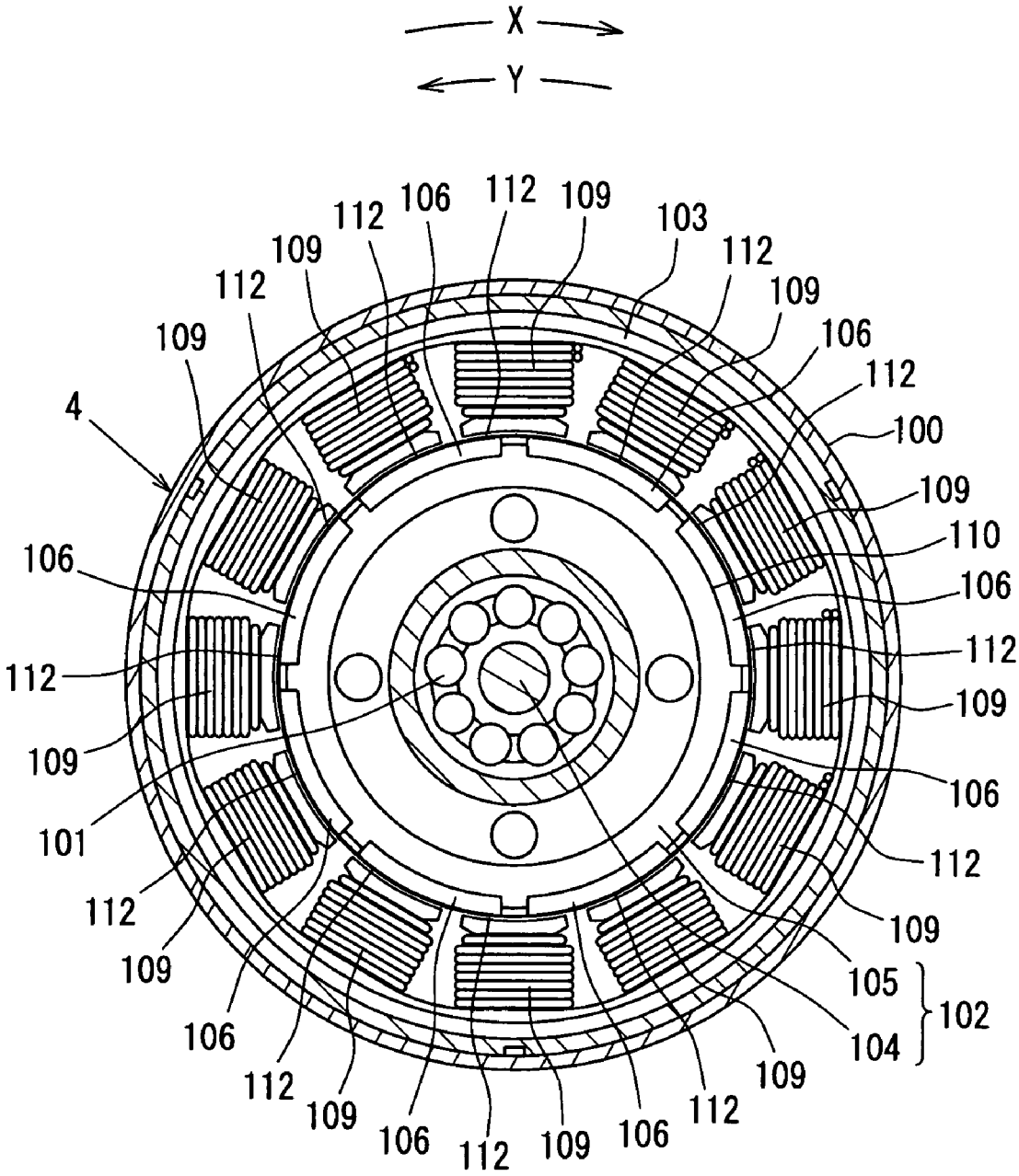
FIG. 2 is a cross sectional view taken along a line II-II in FIG. 1.

As shown in FIGS. 1 and 2, the electric motor 4 is a brushless motor which is provided with a housing 100, two bearings 101, a motor shaft 102, and a motor stator 103. The housing 100 is mounted on the engine through a stay (not shown). The housing 100 accommodates the bearings 101 and the motor stator 103. The bearings 101 support a shaft body 104 of the motor shaft 102 in such a manner that the motor shaft 102 rotates in X direction and Y direction in FIG. 2. The motor shaft 102 includes a rotor portion 105 in which a plurality of permanent magnets 106 are provided at regular intervals. Adjacent permanent magnets 106 generate reverse polarity to each other at outer periphery of the rotor portion 105. The motor stator 103 is coaxially arranged outside of the rotor portion 105. The motor stator 103 includes a core 108 and a coil 109. The core 108 is structured by laminating iron plates. A plurality of cores 108 are provided in the rotation direction of the motor shaft 102 at regular intervals. The coil 109 wound around the core 108 is connected to the current control circuit 6.

The current control circuit 6 is comprised of a driver for the electric motor 4 and a microcomputer. The current control circuit 6 is accommodated in the housing 100. At least a part of the current control circuit 6 can be provided outside of the housing 100. The electric control circuit 6 controls electricity supplied to the coil 109 according to a driving condition of the engine. When the coil 109 is energized, the electric motor 4 is driven so that the motor shaft 102 rotates in X direction and Y direction according to a rotating magnetic field generated by the permanent magnets 106 and the energized coil 109.

As shown in FIG. 1, the phase-change mechanism 8 is provided with a driving rotation member 10, a driven rotation member 20, a planetary carrier 40, and a planetary gear 50.

Figure 3:
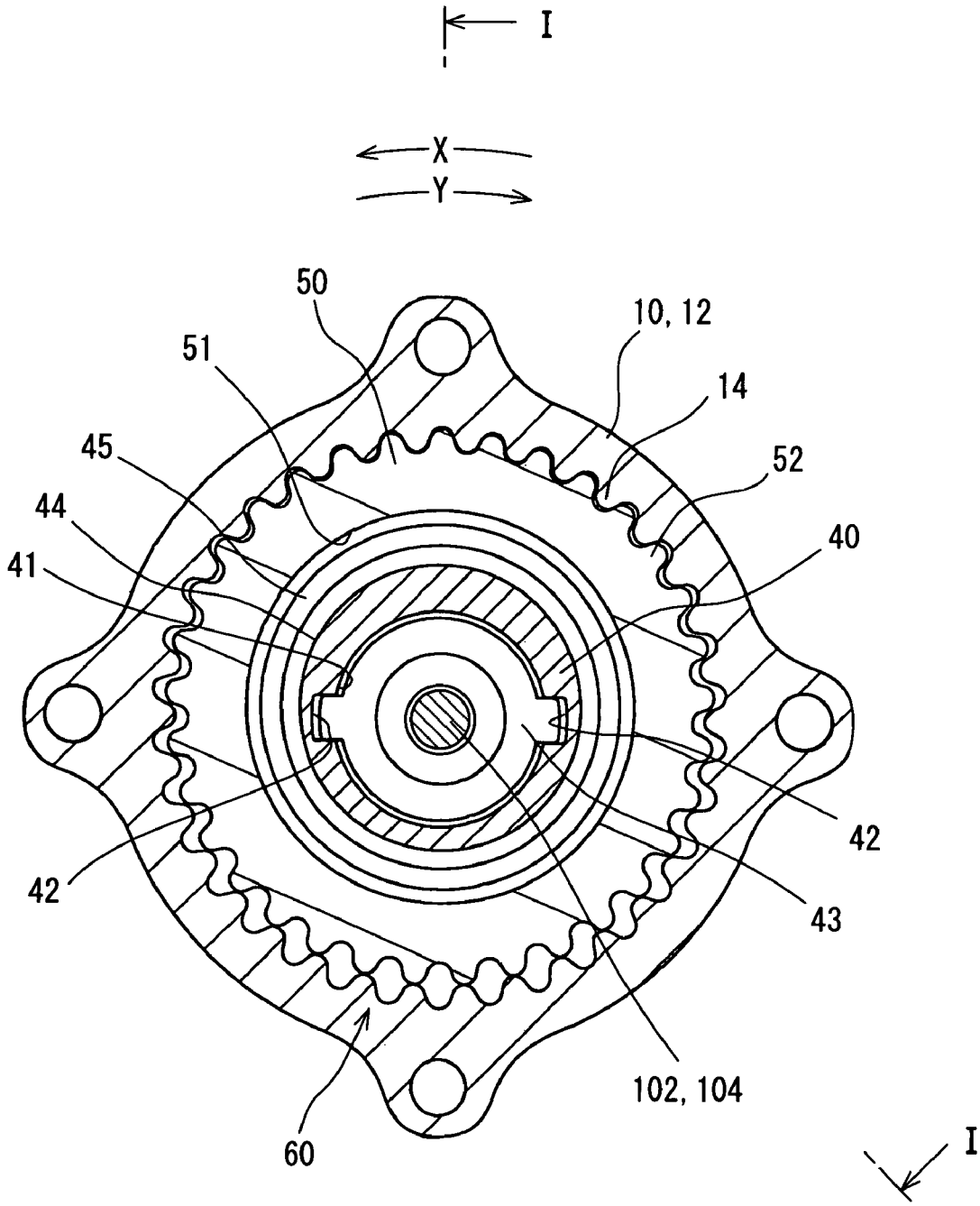
FIG. 3 is a cross sectional view taken along a line III-III in FIG. 1

As shown in FIGS. 1 and 3, the driving rotation member 10 includes a gear member 12 and a sprocket 13, which are coaxially connected by a bolt. The gear member 12 includes a driving internal gear 14 of which addendum circle is inside of its dedendum circle. The sprocket 13 is provided with a plurality of teeth 19. A timing chain is wound around the sprocket 13 and a plurality of teeth of the crankshaft in order to transmit an engine torque from the crankshaft to the sprocket 13. The driving rotation member 10 rotates along with the crankshaft while maintaining the same rotational phase as the crankshaft. The rotation direction of the driving rotation member 10 is a counterclockwise direction in FIG. 3.

Figure 4:
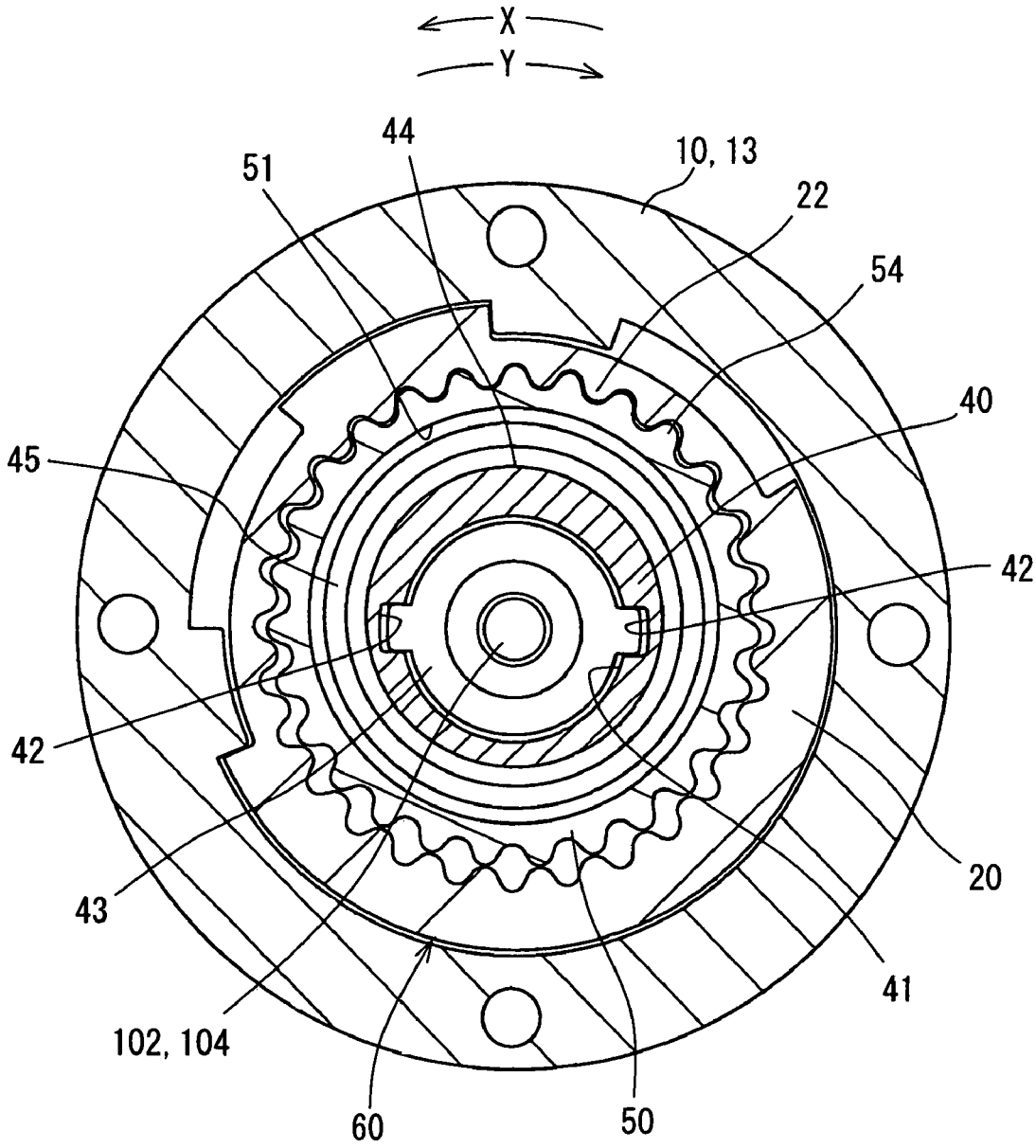
FIG. 4 is a cross sectional view taken along a line IV-IV in FIG. 1.

As shown in FIGS. 1 and 4, the driven rotation member 20 is coaxially arranged inside of the driving rotation member 10. A bottom portion of the driven rotation member 20 forms a connecting portion 21 which is coaxially connected to the camshaft 2 by a bolt. The driven rotation member 20 rotates along with the camshaft 2 while maintaining the same rotational phase as the camshaft 2. The driven rotation member 20 can relatively rotates with respect to the driving rotation member 10. The direction X represents that the driven rotation member 20 is advanced with respect to the driving rotation member 10, and the direction Y represents that the driven rotation member 20 is retarded with respect to the driving rotation member 10.

The driven rotation member 20 is provided with a driven internal gear 22 of which addendum circle is inside of its dedendum circle. Here, an inner diameter of the driven internal gear 22 is smaller than that of the driving internal gear 14. The number of teeth of the driven internal gear 22 is less than that of driving internal gear 14. The driven rotation member 20 is press-fitted into the sprocket 13.

As shown in FIGS. 1, 3, and 4, the planetary carrier 40 is cylindrical as a whole, and forms an input portion 41 at its inner surface. The input portion 41 is coaxially arranged with respect to the driving rotation member 10, the driven rotation member 20, and the motor shaft 102. The input portion 41 is provided with a groove portion 42. The planetary carrier 40 is connected to the motor shaft 102 through a joint 43 engaging with the groove portion 42. The planetary carrier 40 rotates along with the motor shaft 102, and relatively rotates with respect to the driving rotation member 10.

The planetary carrier 40 forms an eccentric portion 44. The eccentric portion 44 is arranged in such a manner as to be eccentric with respect to the internal gears 14, 22. The eccentric portion 44 is engaged with an inner surface of the center bore 51 of the planetary gear 50, whereby the planetary gear 50 rotates around a center of eccentric portion 44 and performs a planetary motion in the rotation direction of the planetary carrier 40.

The planetary gear 50 is provided with a driving external gear 52 and a driven external gear 54. The number of teeth of the driving external gear 52 is less than that of the driving internal gear 14 by a predetermined number N, and the number of teeth of the driven external gear 54 is less than that of driven internal gear 22 by the predetermined number N. Thus, number of teeth of the driven external gear 54 is less than that of driving external gear 52. The driving external gear 52 engages with the driving internal gear 14. The driven external gear 54 engages with the driven internal gear 22.

Inside of the rotation members 10, 20, a differential gear mechanism 60 is provided, in which the driving internal gear 14 is connected to the driven internal gear 22 through the planetary gear 50. When the planetary carrier 40 does not rotate relative to the driving rotation member 10, the rotation members 10, 20 rotate together while the planetary gear 50 maintains the engaging position with the internal gears 14, 22. Thus, the rotational phase is not varied, so that the valve timing is maintained.

When the planetary carrier 40 rotates in direction X with respect to the driving rotation member 10, the planetary gear 50 performs the planetary motion so that the driven rotation member 20 relatively rotates in the direction X with respect to the driving rotation member 10. The rotational phase of camshaft 2 is advanced relative to the crankshaft, so that the valve timing is advanced.

When the planetary carrier 40 rotates in direction Y with respect to the driving rotation member 10, the planetary gear 50 performs the planetary motion so that the driven rotation member 20 relatively rotates in the direction Y with respect to the driving rotation member 10. The rotational phase of camshaft 2 is retarded relative to the crankshaft, so that the valve timing is retarded.

Figure 5:
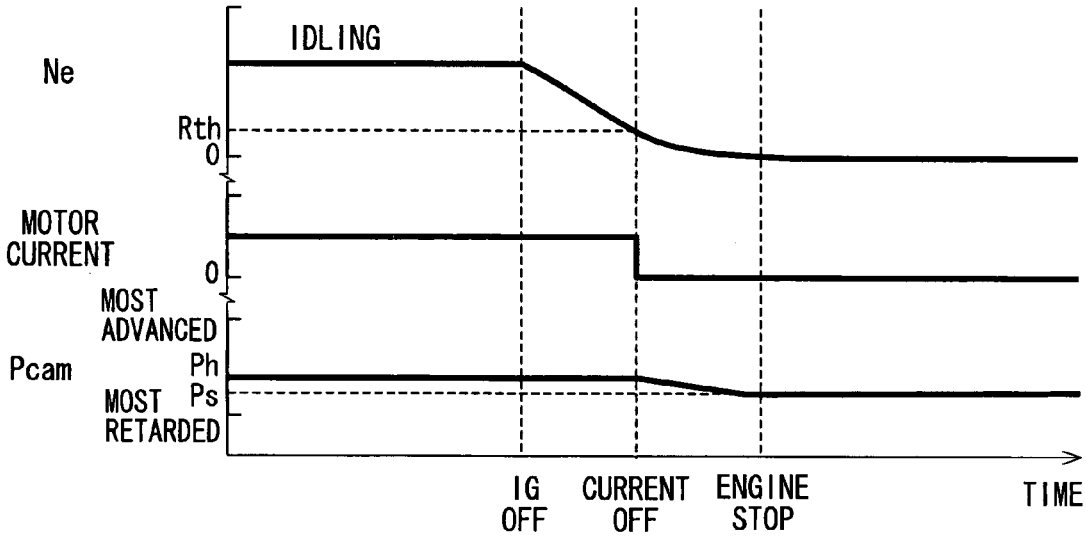
FIG. 5 is a chart for explaining a characteristic operation of the valve timing controller.

When an ignition switch is turned off to stop the engine that is in idling state, the current control circuit 6 controls the electric current supplied to the coil 109 so that a relative phase Pcam is maintained at a specified phase Ph. The relative phase Pcam represents a relative phase difference between the crankshaft and the camshaft. Then, when the engine speed Ne is decreased to a threshold Rth (for example, 200 rpm) or less, the current control circuit 6 stops supplying electricity to the coil 109. The engine is completely stopped and the motor shaft 102 is completely stopped. Alternatively, the motor shaft 102 is stopped in a short period (for example, 0.1 second) after the coil 109 is deenergized. Hence, the relative phase Pcam is brought to a phase Ps that is slightly retarded relative to the phase Ph, as shown in FIG. 5. In this embodiment, the next starting phase of the engine is set at the phase Ps.

Figure 6:
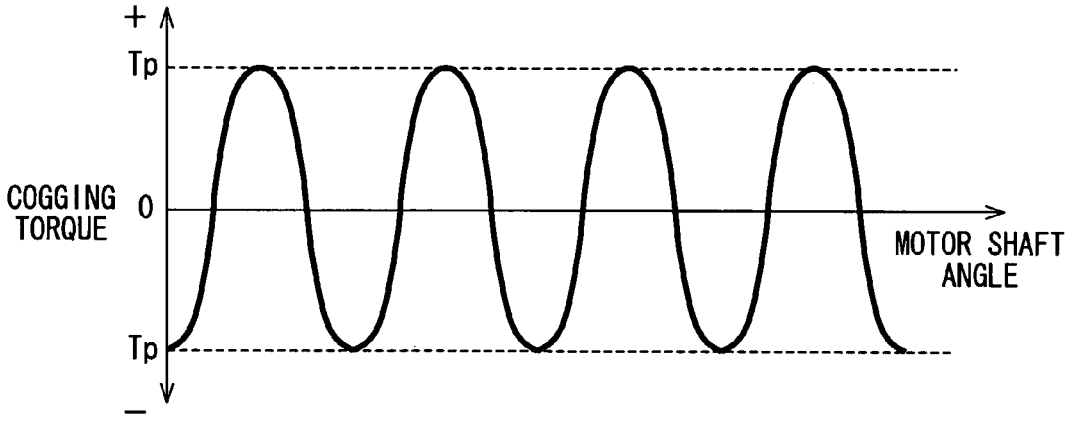
FIG. 6 is a characteristic chart for explaining a characteristic operation of the valve timing controller.

As shown in FIGS. 1 and 2, each permanent magnet 106 is a circular arc in its cross section and is circumferentially provided on outer periphery 110 of the rotor portion 105. The permanent magnets 106 and the motor stator 103 confront to each other through a space 112. Hence, when the coil 109 is not energized, the magnetic force of the permanent magnets 106 is applied to the core 108 through the space 112 so that each core 108 is magnetized, which causes a cogging torque in the motor shaft 102. The cogging torque pulsates according to the position of the motor shaft 102, as shown in FIG. 6. The peak torque of the cogging torque is denoted by Tp. The peak torque Tp is set in such a manner as to satisfy the following equation (1).

$$Tp>Tc \quad (1)$$

wherein Tc denotes an absolute value of cam torque which is applied to the motor shaft 102 through the phase-change mechanism 8. The cam torque is generated when the camshaft 2 is rotated by a valve reactive force in a condition where the engine is stopped and the coil 109 is not energized.

Specifically, the absolute value Tc of the cam torque varies according to the rotational position of the camshaft 2 and a temperature condition. In this embodiment, the peak cogging torque Tp is set in such a manner as to satisfy the following equation (2).

$$Tp>Tcmax \quad (2)$$

wherein Tcmax is a maximum value of the cam torque Tc.

Even if the cam torque due to the valve reacting force is applied to the motor shaft 102 in a condition where the camshaft phase reaches the starting phase Ps, the cogging torque of the motor shaft 102 overcomes the cam torque. As the result, the motor shaft 102 is held at the starting phase Ps even if the cam torque is applied. The starting phase Ps is established by slightly varying from the specified phase Ph, so that the starting phase Ps is substantially constant value every when the engine is stopped.

According to the embodiment, the starting phase Ps is stably obtained when the engine is turned off, and the starting phase Ps is surely hold while the engine is not operated. Hence, the valve timing is realized, which is suitable for operating the engine, especially for starting the engine.

The present invention is not limited to the above embodiment. Various modifications can be applied within a scope of the invention.

For example, the electric motor 4 can be a motor other than the brushless motor as long as it generates a cogging torque. In a case that only one of normal rotation cam torque and reverse rotation cam torque is applied to the motor shaft 102, the maximum value Tcmax of the applied cam torque is set in such a manner as to satisfy the above equation (2).

The permanent magnets 106 can be embedded in the rotor portion 105. The number and the shape of the permanent magnets 106 can be appropriately changed. The number of the core 108 and the coil 109 can be changed according to the number of permanent magnets 106.

The starting phase Ps may be the most retarded phase or the most advanced phase other than the intermediate phase.

The phase-change mechanism 8 can be modified as long as the camshaft phase can be varied according to the motor shaft 102.

What is claimed is:

1. A valve timing controller for an internal combustion engine, the valve timing controller being disposed in a system in which a torque of a crankshaft is transmitted to a camshaft, the valve timing controller adjusting a valve timing of at least one of an intake valve and an exhaust valve, comprising:

an electric motor having a motor shaft and generating a cogging torque on the motor shaft;

an current control means for controlling an electricity supplied to the electric motor, the current control means stopping supplying the electricity to the electric motor after an ignition switch is turned off to stop the engine; and a phase-changing mechanism connecting with the crankshaft and the camshaft, and varying a relative rotational phase between the crankshaft and the camshaft according to a rotation of the motor shaft, wherein the cogging torque has a peak value which is greater than an absolute value of a cam torque applied to the motor shaft from the camshaft through the phase-changing mechanism.

2. A valve timing controller according to claim 1, wherein the peak value of the cogging torque is greater than a maximum estimated value of at least one of a normal rotation cam torque and a reverse rotation cam torque.

3. A valve timing controller according to claim 1, wherein after the current control means supplies an electricity to the electric motor to obtain a specified relative rotational phase when a condition representing the engine will stop is detected, the current control means stops supplying the electricity to the electric motor.

4. A valve timing controller according to claim 1, wherein the electric motor includes a motor stator generating a magnetic field, a motor shaft provided inside of the motor stator, and a permanent magnet provided outer surface of the motor shaft.

5. A valve timing controller according to claim 1, wherein the current control means stops supplying the electricity to the electric motor after the engine is completely stopped.

6. A valve timing controller according to claim 1, wherein the current control means stops supplying the electricity to the electric motor when the engine stop is imminent.

* * * * *